United States Patent [19]

Meins et al.

[11] Patent Number: 4,952,855

[45] Date of Patent: Aug. 28, 1990

[54] SYSTEM FOR MONITORING THE CLOSING OF A DOOR

[75] Inventors: Jürgen Meins, Baldham; Lutz Baur, Riedering, both of Fed. Rep. of Germany

[73] Assignee: Thyssen Industrie AG, Fed. Rep. of Germany

[21] Appl. No.: 272,008

[22] Filed: Nov. 15, 1988

[30] Foreign Application Priority Data

Nov. 16, 1987 [DE] Fed. Rep. of Germany ..... 3738830

[51] Int. Cl.[5] ..... G08C 19/30

[52] U.S. Cl. ..... 318/467; 318/652; 318/653; 340/870.31; 324/207.11

[58] Field of Search ..... 318/264, 265, 266, 272, 318/275, 277, 286, 466, 467, 468, 647, 652, 653, 654; 307/9; 340/870.31; 324/207.11

[56] References Cited

U.S. PATENT DOCUMENTS

| | | | |
|---|---|---|---|
| 3,370,677 | 2/1968 | Federmann et al. | 187/104 X |
| 3,689,814 | 9/1972 | Holt | 318/266 |
| 3,845,843 | 11/1974 | Cohen | 187/104 |
| 4,001,661 | 1/1977 | Terabayashi | 318/264 |
| 4,351,016 | 9/1982 | Felbinger | 318/466 X |
| 4,410,843 | 10/1983 | Sauer et al. | 318/467 |
| 4,463,290 | 7/1984 | Asakawa et al. | 318/467 X |
| 4,631,461 | 12/1986 | Peugeot | 318/466 X |
| 4,635,032 | 1/1987 | Virtanen | 187/104 X |

FOREIGN PATENT DOCUMENTS

WO86/05826 10/1986 PCT Int'l Appl. .

*Primary Examiner*—Bentsu Ro

[57] ABSTRACT

The invention relates to a system for monitoring the closing of a door or other such barrier, such as a sliding door of a vehicle. This system has a circuit outside of the door which serves to emit a signal indicating the open or closed state of the door. In the production of this signal, the need for any electromechanical limit switches or indicating devices mounted on the door and coupled galvanically with the circuit is avoided by providing, in accordance with the invention, a circuit that is mounted on the door. Both circuits have at least one inductive element. The inductive elements are coupled only inductively with one another, but are not in physical contact with one another, so that the production of the signal indicating the open or closed state of the door can be performed contactlessly.

19 Claims, 6 Drawing Sheets

SYSTEM FOR MONITORING THE CLOSING OF A DOOR

BACKGROUND OF THE INVENTION

The invention relates to a system for monitoring the closing of a movable barrier mounted on a frame surrounding an opening and movable back and forth relative thereto between an open state and a closed state, with a first circuit provided outside of the movable barrier for the purpose of emitting a signal indicating the closing state.

Systems of this kind are needed chiefly in vehicles, e.g., in streetcars, trains or subways, to supervise the closing state of doors which have to be operated by remote control from a central point, such as a driver's cab.

Usually the barriers or doors in question are single-leaf sliding doors or doors having two leaves which can slide against one another, which can be driven back and forth in separate frames around the door openings of the passenger compartments by electrical, pneumatic or other actuators. Nevertheless, other kinds of doors may be involved, such as folding doors or swinging doors, as well as other movable barriers such as windows, flaps, sliding valves or the like. [For the sake of simplicity, however, the word "door" will be used herein to refer to all kinds of such movable barriers.]

The door states which are to be signaled are especially the "open" state or "closed" state, and the state of being free to close. This is to be understood to mean that a door is able to close or is in the "free" state if it can be moved to a closed position by the actuator. On the other hand, a door is not closable or is in the "blocked" state when some obstacle, such as a passenger, a box or the like, is blocking the opening and the door therefore cannot be fully closed by operating its actuator.

The states of "open" or "closed" are usually monitored by means of electromechanical limit switches which are actuated when the doors approach their closed positions. These limit switches are disposed on the frame and connected to circuits which emit a signal identifying the "open" or "closed" state and thus indicate the state of the door to the driver of a vehicle or produce a controlling signal. The circuits are disposed outside of the doors, i.e., they are mounted not on the latter but on the frame or other part of the vehicle or the like and therefore are stationary, in contrast to the doors, and can be moved only together with the vehicle or the like.

The presence of an obstruction in the opening might be indicated by monitoring that period of time which is started in the closing operation by actuating the door driver. If one of the signals from the limit switches identifying the "closed" state does not arrive within a predetermined period of time after the actuation of the driver, this signifies that the door in question is in the "blocked" state on account of an obstruction.

Since such systems are often considered to be insufficiently safe, they can have, in addition to the limit switches, a switching means contained within the door itself which responds when the door encounters an obstruction and thereby supplies additional "free" o "blocked" signals which indicate an obstruction or trigger a controlling operation immediately without any predetermined waiting period.

One problem with such means of detection lies in their sensitivity to trouble and hence their insufficient reliability in operation. Their limit switches are subject to considerable mechanical wear, and in extreme cases their position in relation to the doors can change, which would falsify the "open" and "closed" signals. Furthermore, the switch means mounted on the doors themselves are connected to the circuits and indicator mounted outside of the doors by trailing electrical or pneumatic lines which are undesirable for safety reasons. Systems of this kind therefore require careful maintenance that has to be performed repeatedly at frequent intervals of time.

The purpose of the invention is to construct the system of the kind described above such that the signals necessary for the indication of the closing operation and of the closing state of the door are produced without contact, i.e., without mechanical contact by physical components and without galvanic connections between the doors and the circuits provided outside of the doors.

SUMMARY OF THE INVENTION

This purpose is accomplished in accordance with the invention by the fact that the first circuit has at least one first inductive element mounted on the frame and a second electrical circuit having at least one second inductive element is mounted on the door and, for the purpose of the contactless production of the signal indicating the closed state in the first circuit, is inductively coupled with the first inductive element in at least one selected position of the door.

The invention brings with it the advantage that the door-state signals are produced contactlessly by inductive coupling. Mechanical wear and undesired changes of the position of switches or the like are therefore impossible, so that, even with a low frequency of maintenance, a high safety of operation is achieved. The signals "closed" and "open" or "blocked" and "free" can thus be produced with a single second circuit which upon the occurrence of the "blocked" signal simultaneously excludes the emission of the "closed" signal, so that, even if very small obstructions should jam between the door and the frame, the two signals cannot occur simultaneously. Lastly, the system in accordance with the invention can easily be so arranged that trouble in the system, such as power failures, burst lines, short-circuits or the like, will always result in a signaling of the "open" and/or "blocked" state. This has the advantage, especially when the system is used on vehicles, that in the event of trouble in the system there will be no possibility of giving a wrong signal that the vehicle is ready to start.

Additional advantageous features of the invention will be found in the subordinate claims.

BRIEF DESCRIPTION OF THE DRAWINGS

The invention will now be further explained by means of embodiments in conjunction with the appended drawing, wherein.

DESCRIPTION OF PREFERRED EMBODIMENTS

Figure 1:
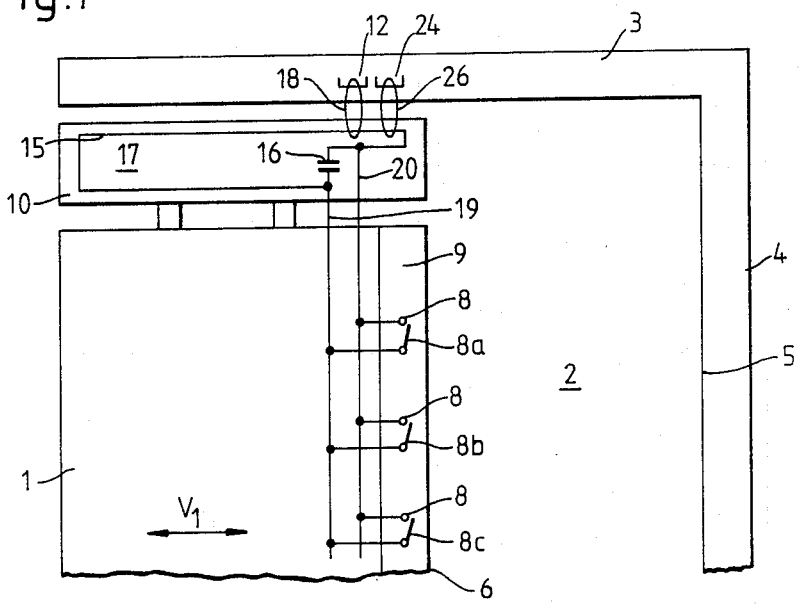
FIGS. 1 and 2 diagrammatically show a system in accordance with the invention for indicating a state of a door which is characterized by an obstruction in the door opening, showing the door in the open state and in the obstructed state, respectively.
Figure 2:
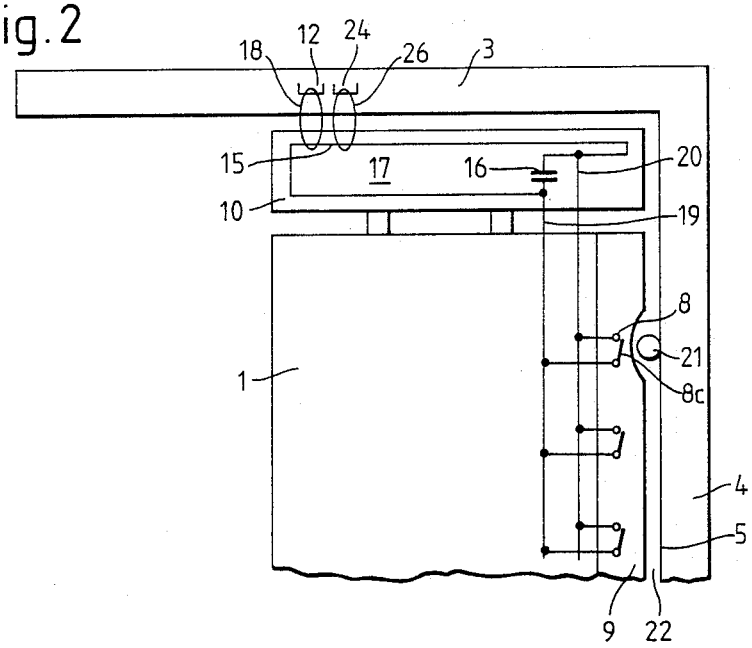

FIG. 1 shows diagrammatically a movable barrier 1, e.g., a sliding door which can be moved back and forth in the direction of an arrow a between its open position in FIG. 1 and its closed position which is nearly reached in FIG. 2. The door 1 in this case is mounted for displacement in a manner not shown in detail in a frame or the like defining an opening 2. This frame contains, for example, a frame member 3 parallel to the direction of movement, and a frame member 4 perpendicular thereto, which contains on its inside a margin 5 against which an edge 6 of the door 1 will abut when the door is in the closed position. The abutment edge 6 is, for example, cushioned by a gasket 7 of an elastic material extending over the entire height of the door 1. The gasket is preferably hollow throughout its length and its interior is provided with a plurality of switches 8 spaced parallel to the edge 6. These switches 8 consist, for example, of momentary contact or pressure switches with movable contacts 8*a*, 8*b*, 8*c* etc., which are held in the normally open position by a spring or the like and face the abutment edge 6. If a local pressure is applied to the abutment edge 6 in the area of any of the switches 8, thereby pressing the gasket 7 inwardly, at least one of the movable contacts 8*a, b, c* will close the corresponding switch 8. All switches 8 together form a switch system 9.

At the upper end, in FIG. 1, the door 1 has a bar 10 which is disposed closely parallel to the frame member 3. The bar 10 is moved back and forth together with the door 1, extends preferably over its entire width, and can be covered cladding.

Figure 5:
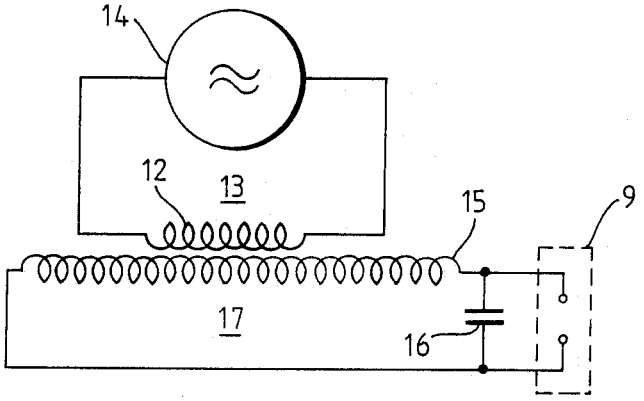
FIGS. 5 to 7 are schematic diagrams of electrical circuits for the systems of FIGS. 1 to 4.

An inductive element 12 acting as a sender is mounted on the frame member 3, and consists of a conductor loop (FIG. 1) with a section parallel to the direction of movement, or a corresponding coil with several turns of wire in a circuit 13 in FIG. 5, which consists preferably of the element 12 and an oscillator 14 connected to its terminals, which produces an alternating current of, e.g., 100 kHz. When the oscillator 14 is turned on a high-frequency alternating electromagnetic field develops in the inductive element 12.

A second inductive element 15 is affixed to bar 10 and extends best over its entire length, and it too can consist of a conductor loop (FIG. 1) and a section parallel to the direction of movement or a corresponding coil (FIG. 5) with several turns of wire, and forms together with a condenser 16 connected in series an additional electrical circuit 17 in the for of a resonant circuit. Without any physical contact between them, the two inductive elements 12, 15 are arranged on the frame member 3 and bar 10 so that the sections are inductively coupled to one another regardless of the position of the door 1, i.e., both in the open and closed positions of the door and in all possible positions in between, as indicated schematically in FIG. 1 by a closed loop 18. So that the coupling factor will be the same in all positions, the length of the section of the inductive element 15 is at least equal to the length of the possible movement of the door 1, while the corresponding section of element 12 should have a comparatively small length and be coupled with an equal portion of element 15 in any position of the door 1. The energizing of the oscillator 14 (FIG. 5) will thus result in contactless induction of an alternating current in the inductive element 15. At the same time the capacity of the condenser 16 is preferably made such that this alternating current will be maximum under the given circumstances, i.e., the reactive component of the impedance of the inductive element 15 will be just compensated by that of the condenser 16.

The circuit 17 furthermore contains two conductors 19 and 20 which are connected to both terminals of the condenser 16 and are laid in the door 1. Conductor 19 is connected to one side of each of the switches 8 and line 20 to the other side of same. As a result, either the two conductors 19 and 20 connected to the condenser 16 are interrupted if all switches 8 are in their open position, as in FIG. 1, or, as in FIG. 2, the condenser 16 is by-passed or short-circuited whenever at least one switch 8 is closed. This will happen, for example, if upon the closing of the door 1 an obstruction 21 indicated diagrammatically in FIG. 2, is in the opening 2 and is wedged between the edge 5 and the abutment edge 6, so that the door 1 possibly cannot be completely closed and at least a gap 22 remains in the opening 2. Since the closing causes at least one of the switches 8 to short-circuit the condenser 16, the capacitive portion of the reactive component of the impedance of circuit 17 is in this case eliminated, thereby reducing the alternating current, which originally was great when oscillator 14 was turned on, to a comparatively low level.

In FIGS. 1 and 2, an additional inductive element acting as a receiver is affixed to frame member 3; like element 12, this element 12 can consist of a conductor loop (FIG. 1 with a section parallel to the direction of movement, or a corresponding coil with several turns of wire, and is connected into an additional electrical circuit 25 provided outside of the door 1. The elements 15 and 24, without any physical contact with one another, are affixed to the bar 10 and to frame member 3 in such positions that their said sections are coupled inductively to one another regardless of the position of the door 1, i.e., both when the latter is open and when it is closed, as well as in all possible intermediate positions, as is indicated diagrammatically in FIG. 1 by a loop 26. So that the coupling factor will be the same in all positions, the physical relationship of the elements 15 and 24 will be substantially the same as the physical relationship of elements 12 and 15. Thus, when the oscillator 14 is turned on (FIG. 5), a flow of current will be induced contactlessly in every position of the door, and its magnitude will depend on the magnitude of the alternating current flowing in circuit 17, and thus on whether all switches 8 are open or at least one switch 8 is closed. Otherwise the elements 12 and 24 are physically mounted on frame member 3 such that their direct inductive coupling will be as small as possible.

Figure 6:
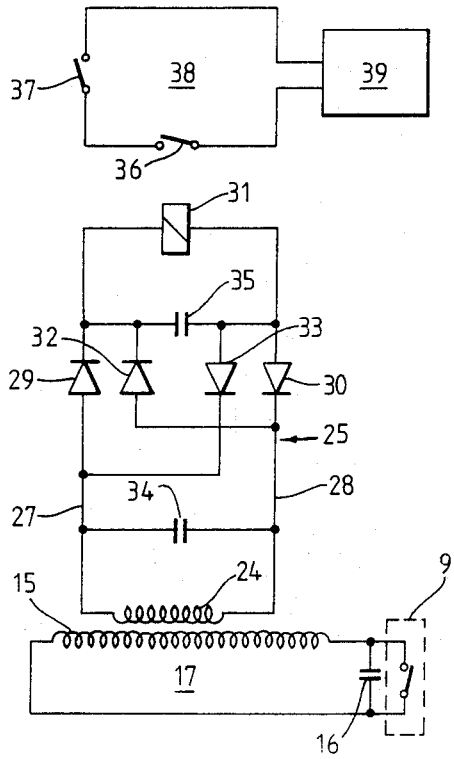

In FIG. 6, circuit 25 contains two conductors 27 and 28 connected to the ends of element 24, and connected each through a diode 29, 30, to the two terminals of a relay 31. Furthermore, the output of an additional diode 32 is connected to the output of diode 29, while its input is connected to the output of diode 30, and the input of diode 29 is applied to the output of a fourth diode 33 whose input is connected to the input of diode 30, so that the four diodes 29, 30, and 32, 33, form a bridge rectifier in a conventional Graetz circuit for the alternating current induced in circuit 25. Parallel to the element 24 is a condenser 34 which with element 24 forms a parallel resonant circuit, and parallel to the relay 31 there is provided an additional condenser 34 which acts as a smoothing condenser for the alternating current rectified by the bridge rectifier. The relay 31 furthermore acts on the moving contact of a switch 36 which is normally open. This switch 36 is connected together with an additional circuit 37 in a circuit 38, not further represented, which turns on and off a drive 39, also not further represented, for the automatic opening and closing of the door 1. Switch 37 is at the same time to represent the switch which is actuated whenever the command "open" and/or "close" is to be given for the door.

The manner of operation of the system shown in FIGS. 1, 2, 5 and 6 is as follows:

In the energized operating state, i.e., especially when the oscillator 14 (FIG. 5) is turned on, a voltage of predetermined magnitude is induced in element 15 through the inductive element 12, regardless of the position of the door 1. As a result, an alternating current of predetermined magnitude is also induced in element 24 and is independent of the position of the door 1. This alternating current is of such a level that the relay closes the switch 36 normally held open by a spring or the like. This prepares the circuit 38, so that actuation of switch 37 can start up the drive 39. Circuit 25 thus gives a signal ding to the "free" state.

The door 1 is now pushed to the open or closed position until a limit switch yet to be described responds. If, however, during a closing movement an obstruction (e.g. 21 in FIG. 2) is in the opening 2, this obstacle will cause at least one of the switches 8 normally in the open state to close, thereby bypassing the condenser 16 of circuit 17. As a result, the current in circuit 17 is considerably reduced and therefore no longer suffices to induce in the inductive element 24 a voltage sufficient to cause relay 31 to respond. Consequently, switch 36 opens, thereby interrupting circuit 38 and stopping the drive 39. The door 1 therefore comes to a stop as soon as an obstacle is caught between the door 1 and the edge 5. The response sensitivity depends, among other things, on the elastic properties of the gasket 7, the closing force of switch 8, the force exerted by drive 39 on the door 1, and the pressure that is exerted by the obstacle 21 on the gasket 7. The arrangement is best made such that the total pressure per unit area exerted on the gasket 7 in the closed state will not suffice to shift the switch system 9 to the state in which it will signal an obstruction.

Figure 3:
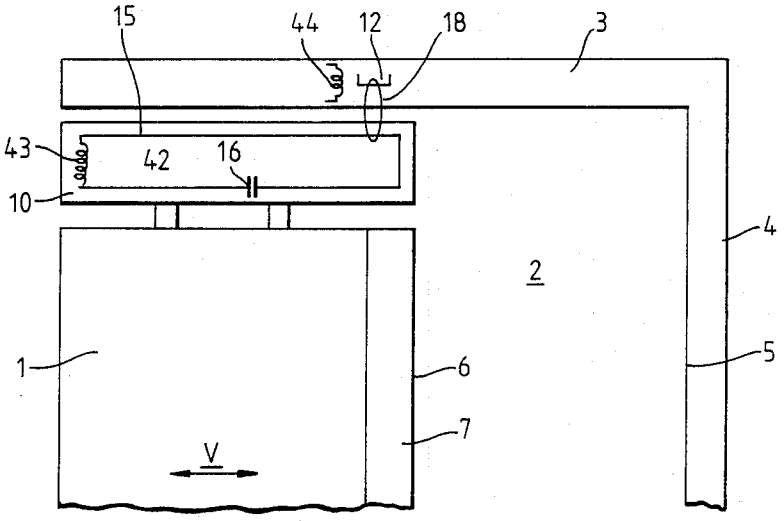
FIGS. 3 and 4 diagrammatically represent a system in accordance with the invention for verifying the closed state of a door, showing the door open and fully closed, respectively.
Figure 4:
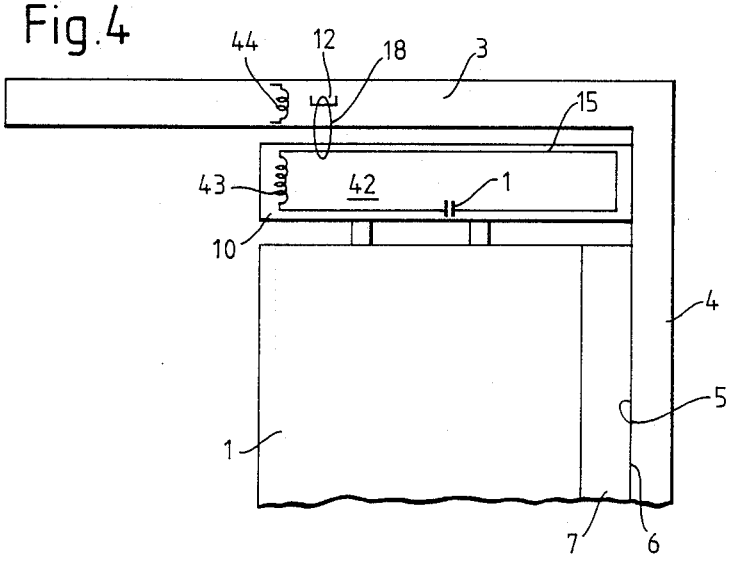

FIGS. 3 and 4 show a system similar in principle to the system in FIGS. 1 and 2, equal parts being identified by the same reference number.

A circuit 42 mounted on the door 1 contains in this case not only the condenser 1 and the inductive element 15 fastened to the bar 10, but also an additional inductive element 43 which consists of a conductor loop or a coil with several turns of wire, is connected in series with element 15, and like the latter is moved back and forth with the door 1. Element 43 forms with element 15 and the condenser 16 a resonant circuit in which the condenser 16 again serves to keep the reactive component of the impedance low or to compensate it, so that when oscillator 14 (FIG. 5) is turned on a high alternating current flows in circuit 42. Element 43 of preferably arranged physically so that it will have, insofar as possible, no direct inductive coupling with the two elements 12 and 15, its axis being represented perpendicular to the axes of elements 12 and 15 for this purpose. Element 24 in FIGS. 1 and 2 is furthermore replaced with an inductive element 44 acting as a receiver which is disposed on the frame member 3. At the same time the relative arrangement of the inductive elements 43 and 44 is made such that a strong inductive coupling exists between them only when the door is in the closed position shown in FIG. 4.

Figure 7:
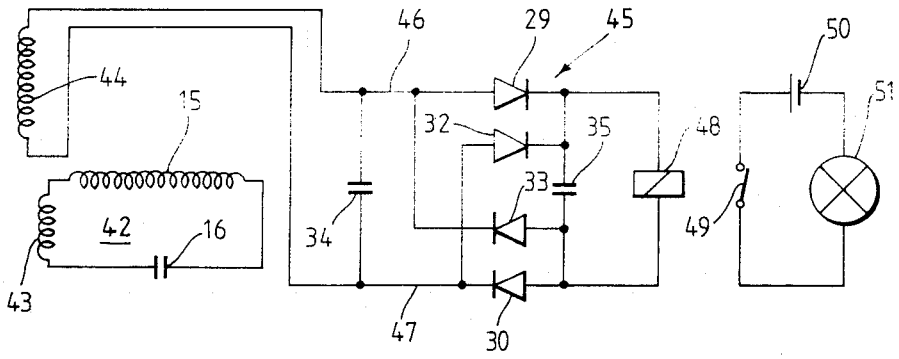

In FIG. 7 the inductive element 44 is wired in a circuit 45 disposed outside of the door 1 and has two conductors 46 and 47 connected to the ends of element 44, which are connected to the two terminals of a relay 48. Otherwise circuit 45 contains, like circuit 25 in FIG. 6, the four diodes 29, 30, and 32, 33, forming a bridge rectifier, as well as the two condensers 34 and 35. Relay 48 acts on a switch 49 normally held open by a spring or the like, which is in series with a diagrammatically indicated battery 50 and a pilot light 51.

The manner of operation of the system seen in FIGS. 3, 4, 5 and 7 is as follows:

In the energized operating state, i.e., especially when the oscillator 14 is turned on (FIG. 5 , a current of predetermined magnitude is induced in circuit 42 through element 12, independently of the position of the door 1. This current also flows through element 43, but remains ineffective as long as the door is in the open position or an only partially closed position, because in these positions there is no sufficient inductive coupling between the elements 43 and 44. Consequently, the alternating current induced in circuit 45 in these positions is very low or nil, so that the current flowing through the relay 48 is not sufficient to close switch 49. If, however, the abutment edge of the door 1 engages the edge 5 of the frame member 4 after the door is closed, then the great inductive coupling desired and established by their physical position in relation to one another will result in a voltage in element 44 which will cause relay 48 to respond. Consequently switch 49 is closed and the pilot lamp 51 will light, signaling the closing of the door 1. Circuit 45 in this case emits a signal indicating the "closed" state.

Alternatively, element 44 could be replaced by an element mounted on frame member 4, which would be coupled inductively with sufficient strength in the closed state with an inductive element corresponding to element 43 and mounted at the right end of the bar 10. The arrangement represented is especially desirable when the door is one leaf of a two-leaf vehicle door or the like, whose both leaves are moved against one another to close the door and which abut against one another at their longitudinal edges when closed.

The two systems for monitoring the closing of the door 1, which are represented separately in FIGS. 1, 2 and 6 on the one hand and FIGS. 3, 4 and 7 on the other, can also be combined in a simple manner, for example by providing circuit 17 in FIGS. 1 and 2 with an additional inductive element corresponding to inductive element 43 in FIGS. 3 and 4 and using accordingly two circuits according to FIGS. 6 and 7. The manner of operation is then the same, with the additional advantage that, when one of the switches 8 responds (FIGS. 1, 2) in no case can switch 49 (FIG. 7) be actuated thereby erroneously giving the signal "closed", even if the obstruction 21 (FIG. 2) is very thin and consists only of a finger or the like. This is because when one of the switches 8 responds, the condenser 16 (FIGS. 1, 2) is bypassed and thus the current flowing through elements 15 and 43 is made very low, and the voltage that is induced in circuit 45 will not suffice to close switch 49 even if the door 1 has reached the closed position except for the small gap 22 (FIG. 2) and therefore the inductive coupling between the elements 43 and 44 is already quite great.

Figure 8:
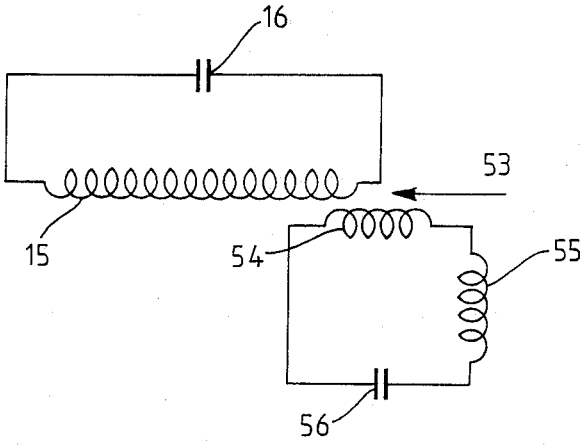
FIG. 8 is a schematic diagram of an alternative embodiment of the second circuit of the system of FIGS. 3 and 4.

Furthermore, as indicated diagrammatically in FIG. 8, the circuit 42 according to FIGS. 3, 4 and 7 could be replaced by a circuit 53 which includes only element 15 and the condenser 16 in series, and in which two additional inductive elements 54 and 55 are provided which are connected in series with an additional condenser 56. In this case the one inductive element 54 would be constantly coupled with the inductive element 15 while the other inductive element 55 would assume the function of element 43 in FIG. 7. In this embodiment the current necessary for indicating the closed state of the door 1 is likewise contactlessly coupled by inductive element 12 to the circuit mounted on the door 1 and transferred by the latter to an additional circuit in accordance with the state that is to be indicated.

All embodiments described in connection with FIGS. 1 to 8 have it in common that they have a first circuit 25 or 45 situated outside of the door 1 for issuing a signal indicating the closed state, this first circuit having at least one first inductive element 24 and 44, respectively. Furthermore, a second circuit 17, 42, and 53, respectively, with at least one second inductive element 15, 43, 54, 55, is mounted on the door 1, and is inductively coupled with the first element in at least one position (FIGS. 3, 4 and 8) or also in all positions of the door 1 (FIGS. 1 and 2) in order thereby to produce contactlessly in the first circuit the signal identifying the state of closure of the door. Furthermore, a third circuit 13 with a third inductive element 12 is provided preferably at a point situated outside of the door, which serves to couple contactlessly to the second circuit the electrical energy necessary to indicate the state of the door. In all variants the advantages are furthermore obtained that in the second circuit only the energy necessary for door-state indication needs to be coupled and that when a short-circuit, a line break, a power failure or any other trouble occurs in the system, the "closed" signal can never be given, which is important especially for the use of the described systems as door monitors on streetcars, railroads or subway trains and other such vehicles.

The switches 8 can be any desired capacitive, piezoelectric or other such switching means, or even photoelectric cells or the like, which can assume at least two states, and normally are in the one state, and when an obstruction is caught between the door 1 and the frame member 4 (or a second door), are shifted to the other state in order thereby to produce a current different from the normal in the second circuit. It is furthermore possible to construct the inductive elements represented schematically as coils as single or multiple large-area conductor loops which can also be given a figure-eight geometrical configuration.

Figure 9:
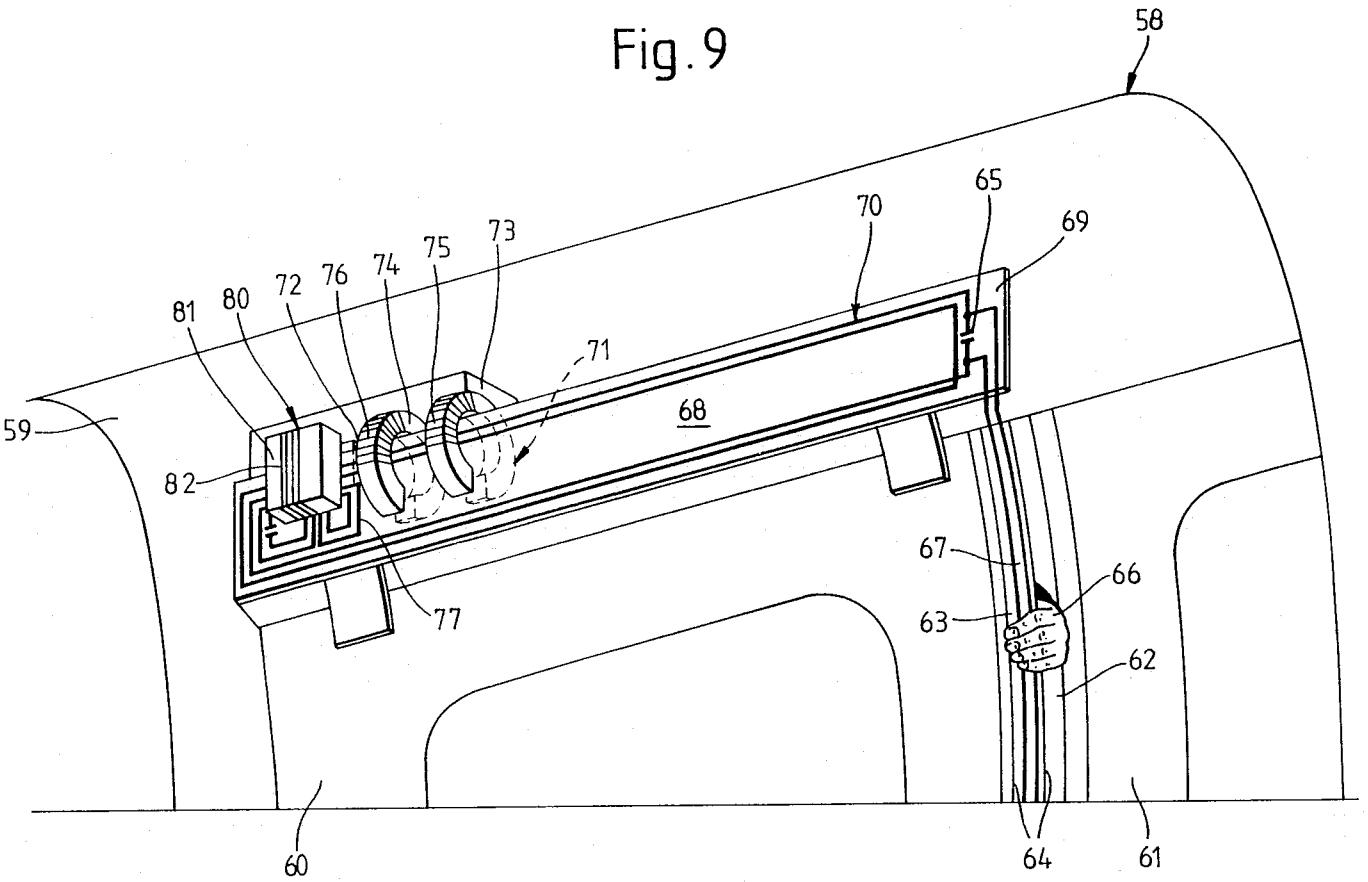
FIG. 9 is a diagrammatic representation of the application of a system according to the invention to a vehicle door.

A practical embodiment of the invention is represented in FIG. 9 in conjunction with a diagrammatically indicated passenger compartment 58 of a streetcar, train or subway car. A door 60 displaceably mounted in a frame 59 strikes in its closed state against a frame member 61 or a second door leaf mounted for displacement in the contrary direction. The door 60 is provided on its abutment side with a resiliently yielding gasket 62 which has an internal cavity 63 through its entire length. In this cavity is a switch system 64 which consists of two resiliently flexible bare contact strips made from an electrically conductive material, which extend preferably also over the entire length of the gasket 62 and are connected at their ends to the two terminals of a condenser 65, while their other ends are free. Normally, the contact strips are nowhere in contact with one another, so that the condenser 65 acts as a capacitive element of preselected magnitude. If, however, a hand 66, for example, is caught in the gap between the door 60 and the frame member 61, the gasket 62 yields resiliently at this point, causing the contact strips to flex resiliently and come in contact one another, as indicated in FIG. 9 by a broken line 67, so that the condenser 65 is short-circuited. The two contact strips thus have the same effect as a plurality of individual switches 8 disposed closely one above the other as indicated in FIGS. 1 and 2.

In FIG. 9 the condenser 65 is connected in a circuit 68 which is mounted on a bar 69 fastened to the door 60, and connected to the two terminals of an inductive element 70 which consists of a conductor loop with two parallel coils of an electrically conductive wire or the like which are substantially congruent with one another and disposed in a rectangular shape. Two additional inductive elements 71 and 72 consist of a ferrite core 73 and 74, each in the form of a slotted ring on which a number of turns 75 and 76 of an electrically conductive wire or the like are wound. The ferrite cores 73 and 74 surround a section of element 70 running parallel to the direction of movement of the door 60, this section being substantially perpendicular to the central planes of the ferrite cores 73 and 74, and running approximately through their central axes. The ends of the winding 75 are connected to the conductors 27 and 28 of FIG. 6 and the ends of the winding 76 are connected, for example, to the oscillator 14 in FIG. 5. When the oscillator 14 is turned on, therefore, an electromagnetic alternating field is produced by element 72 and induces an alternating current in the section surrounded by it and thus in the entire element 70. This current produces a magnetic alternating field (right-hand rule) concentrically surrounding the conductors of element 70, and this field in turn passes through the ferrite core 73 and results in an induced current in the winding 75 of element 71. The physical arrangement and manner of operation are to this extent the same as in the system according to FIGS. 1 and 2.

Figure 10:
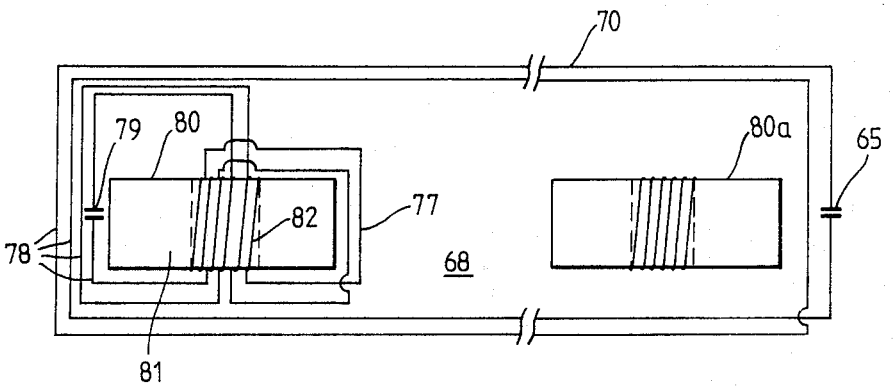
FIGS. 10 and 11 are an enlarged front view and top view of details of three inductive elements of the system according to FIG. 9.
Figure 11:
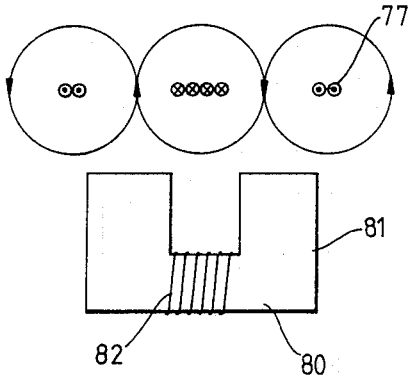

In FIGS. 9 to 11 an additional inductive element 77 is disposed inside of the left end of the element 70, and acts like element 43 in FIG. 7 and element 54 in FIG. 8. Element 77 consists of a loop of two conductors shaped in the manner of a flat figure eight, whose portions are substantially rectilinear and whose central plane substantially coincides with the central plane of element 70. As seen in FIGS. 10 and 11, in which the elements 71 and 72 have been omitted for the sake of simplicity, if element 77 is in the working state, for example on the side marked with a solid line 78, over the magnetic field which is produced by the current flowing through the element 70, it is inductively coupled with element 70, so that a current also flows in element 77. The reactive component of its impedance can be compensated by a condenser 79. The current in element 77 results in the magnetic field indicated schematically by circular arrows for half a period, which is strongest on both sides of the center part of the figure-eight conductor loop, because four sections of conductor situated parallel side by side have current flowing through them, while on the two sides only two sections of conductor are present. In FIG. 10 these four sections of conductor are partially covered by an inductive element 80 whose construction is to be seen particularly in FIG. 11, while the conductors of elements 70 and 77 are represented in section as usual.

The detection of the magnetic field produced by element 77 is performed by inductive element 80, which is in the form of a U-shaped ferrite core 81 on which a coil 82 is wound; its action is the same as that of element 44 in FIGS. 3 and 4. Element 80 is fastened to the frame 59, while element 77 is mounted like element 70 on the bar 69 such that, when the door 60 is closed, it assumes precisely the symmetrical center position seen in FIG. 11, closely beneath the element 80 in which the two pole faces of the ferrite core 81 are substantially parallel to the central plane of element 77 and precisely aligned with the two halves of the figure eight loop, so that the ferrite core 81 has maximum permeation. In the closed state, this produces a maximum signal in element 80, while slight shifts of the door produce a highly unsymmetrical positioning of element 80 relative to element 77 and hence they produce a substantially weaker induced signal. When door 60 is open, element 80 assumes approximately the position 80*a* represented in FIG. 10, in which there is virtually no inductive coupling with element 77. The manner of operation is therefore the same as in FIGS. 3 and 4 and FIG. 8. An advantage of the arrangement according to FIGS. 10 and 11 is that the elements 77 and 80 can be very small in size, so that a closely limited threshold value can be established for the switching signal and thus the closed position can be established within narrow limits.

The invention is not limited to the embodiments described, which can be modified in many ways. Especially the arrangement and configuration of the various inductive elements and circuits can be adapted to the particular application and therefore can differ from FIGS. 1 to 11. It is also possible to combine the functions of various inductive elements in a single inductive element and a single circuit. For example, inductive element 12 can be placed in a circuit which on the one hand supplies electrical energy for circuit 17 and on the other hand acts on a positioning element and thus makes it possible to recognize the current state of the switch system 9 or of the door. In such an embodiment, therefore, one of the elements 12 or 24 could be omitted.

What is claimed is:

1. A system for monitoring the closing state of a movable barrier which is mounted on a frame defining an opening and is movable between an open and a closed position, said system comprising: first electric circuit means mounted on said barrier for being moved therewith and including first inductive means; and second electric circuit means mounted outside said barrier and including second inductive means and an oscillator means for producing, if switched on, an electric current in said second circuit means; said first and second inductive means being arranged with respect to each other in such a way that, if said oscillator means is switched on, said second inductive means is enabled to contactlessly induce electric energy in said first inductive means for activating said first electric circuit means, and said first inductive means is enabled to contactlessly induce an electric signal characteristic of a closure state of said barrier in second inductive means in at least one selected position of said barrier.

2. A system according to claim 1, wherein said first inductive means includes a first inductive element and wherein said second inductive means includes a second inductive element, said first and said second inductive elements being inductively coupled in any position of said barrier for activating said first electric circuit means in any position of said barrier.

3. A system according to claim 2, wherein said second inductive means includes a third inductive element, said first and said third inductive element being inductively coupled in any position of said barrier for inducing a first electric signal characteristic of a first closure state of said barrier in said third element in any position of said barrier.

4. A system according to claim 1, wherein said second inductive means includes a fourth inductive element and wherein said first inductive means is substantially inductively coupled with said fourth inductive element only in said selected position of the barrier for substantially inducing a second electric signal characteristic of a second closure state of the barrier in said fourth inductive element only in said selected position.

5. A system according to claim 4, wherein said first inductive means includes a fifth inductive element substantially inductively coupled with said fourth inductive element only in said selected position of said barrier for inducting said second signal in said fourth inductive element only in said selected position.

6. A system according to claim 1, wherein said first inductive means includes a first and a fifth inductive element and wherein said second inductive means includes a second and a fourth inductive element, said first and said second inductive elements being inductively coupled in any position of said barrier for activating said first electric circuit means in any position of the barrier, and said fourth and said fifth inductive elements being substantially inductively coupled only in said selected position for substantially inducing a second signal in said fourth inductive element only in said selected position.

7. A system according to claim 1, wherein said second inductive means includes a second, a third and a fourth inductive element, said second and said third inductive elements being inductively coupled with said first inductive means for activating said first electric circuit means and inducing a first signal in said third inductive element in any position of the barrier, and said fourth element being inductively coupled with said first inductive means for substantially inducing a second signal in said fourth element only in said selected position of said barrier.

8. A system according to claim 1, wherein said first inductive means includes a first and a fifth inductive element and wherein said second inductive means includes a second, a third and a fourth inductive element, said first and said second inductive elements being inductively coupled in any position of said barrier for activating said first electric circuit means in any position of said barrier, said first and said third inductive elements being inductively coupled in any position of said barrier for inducing a first signal in said third element in any position of the barrier and said fourth and said fifth inductive elements being substantially inductively coupled only in said selected position for substantially inducing a second signal in said fourth element only in said selected position of said barrier.

9. A system according to claim 1, 2, 3, 4, 5, 6, 7 or 8, wherein said selected position is the closed position of said barrier.

10. A system according to claim 2, 3, 6 or 8, wherein said first inductive element is disposed parallel to the direction of movement of said barrier, said first inductive element having a length corresponding at least to the length of possible movement of said barrier, and wherein said second inductive element is disposed so as to be inductively coupled with a portion of equal length of said first inductive element in any position of said barrier.

11. A system according to claim 3 or 8, wherein said first inductive element is disposed parallel to the direction of movement of said barrier, said first inductive element having a length corresponding at least to the length of possible movement of said barrier, and wherein said third inductive element is disposed so as to be inductively coupled with a portion of equal length of said first inductive element in any position of said barrier.

12. A system according to claim 2, 3, 6, 7 or 8, wherein said second electric circuit means has a first circuit including said second inductive element and said oscillating means.

13. A system according to claim 3, 7 or 8, wherein said second electric circuit means as a second circuit, said second circuit including said third inductive element.

14. A system according to claim 4, 5, 6, 7 or 8, wherein said second electric circuit means has a third electric circuit, said third circuit including said fourth inductive element.

15. A system according to claim 1, 2, 3, 7 or 8, wherein said first electric circuit means is a resonant circuit including said first inductive means and a condenser.

16. A system according to claim 1, 2, 3, 7 or 8, wherein said first electric circuit means is a resonant circuit including said first inductive means, a condenser and a switching system being mounted on said barrier for movement therewith and serving for short-circuiting or not short-circuiting said condenser, respectively, said switching system having states, one state being characteristic of a "blocked" barrier and another state being characteristic of a "free" barrier.

17. A system according to claim 1, 2, 3, 7 or 8, wherein said barrier has an abutment edge perpendicular to the direction of movement of said barrier and wherein said first electric circuit means is a resonant circuit including said first inductive means, a condenser and a switching system, said switching system having two bare, elastically flexible, electrical contact strips, said strips being provided at said abutment edge, said strips, if in contact, short-circuiting said condenser and, fi out of contact, not short-circuiting said condenser.

18. A system according to claim 1, 2, 3, 7 or 8, wherein said barrier has an abutment edge being disposed perpendicular to the direction of movement of said barrier and being formed by an elastically deformable sleeve, and wherein said first electric circuit means is a resonant circuit including said first inductive means, a condenser and a switching system being disposed within said sleeve, said switching system serving for short-circuiting or not short-circuiting said condenser, respectively, and having at least two states, one state being characteristic of a "blocked" barrier and another state being characteristic of a "free" barrier.

19. A system according to claim 1, 2, 3, 4, 5, 6, 7 or 8, wherein said barrier is a vehicle door.

* * * * *